United States Patent [19]

Bonner

[11] 4,248,179

[45] Feb. 3, 1981

[54] INTERNALLY GROOVED HEAT TRANSFER CONDUIT

[75] Inventor: Stanley V. Bonner, Potterville, N.J.

[73] Assignee: Foster Wheeler Energy Corporation, Livingston, N.J.

[21] Appl. No.: 57,240

[22] Filed: Jul. 13, 1979

[51] Int. Cl.[3] ..... F28F 1/40

[52] U.S. Cl. ..... 122/235 C; 29/157.3 AH; 122/367 C; 138/38; 138/177; 165/177; 165/184

[58] Field of Search ..... 165/184, 133, 177, 179; 138/38, 177; 29/157.3 AH; 122/367 C, 235 C

[56] References Cited

U.S. PATENT DOCUMENTS

| | | | |
|---|---|---|---|
| 1,110,127 | 9/1914 | Gray | 138/177 |
| 2,491,692 | 12/1949 | Shimek | 138/177 |
| 2,525,092 | 10/1950 | Bruegger | 29/157.3 AH |
| 3,088,494 | 5/1963 | Koch et al. | 165/133 |
| 3,217,799 | 11/1965 | Rodgers | 138/38 |
| 3,885,622 | 5/1975 | McLain | 138/38 |
| 3,930,627 | 1/1976 | Miller | 138/38 |

FOREIGN PATENT DOCUMENTS

| | | | |
|---|---|---|---|
| 932716 | 9/1955 | Fed. Rep. of Germany | 138/38 |
| 899755 | 6/1962 | United Kingdom | 29/157.3 AH |

*Primary Examiner*—Sheldon Richter

*Attorney, Agent, or Firm*—Marvin A. Naigur; John E. Wilson; John J. Herguth, Jr.

[57] ABSTRACT

A heat transfer conduit is provided having a groove formed in its inner wall and a lip extending along the groove adjacent thereto. The lip and groove inhibit the formation of a vapor barrier between the tube inner wall and heat transfer fluid passed therethrough.

9 Claims, 6 Drawing Figures

FIG. 1
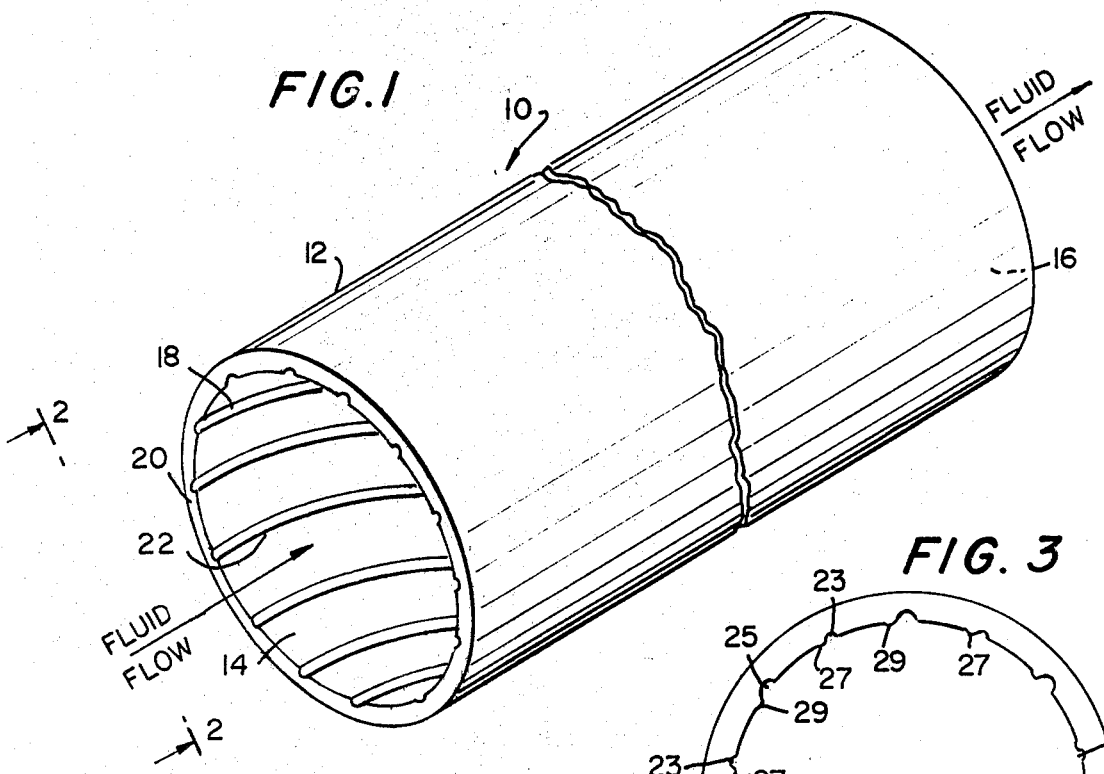
FIG. 3
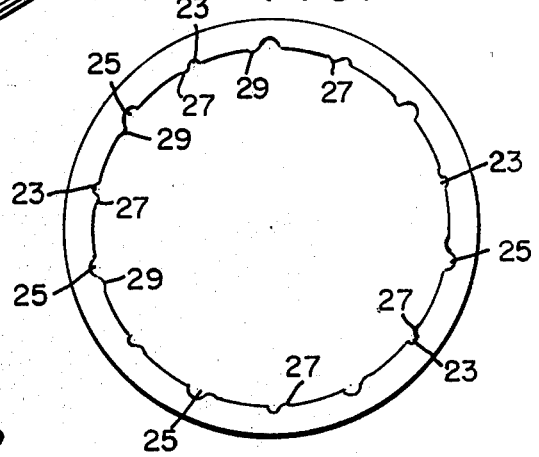
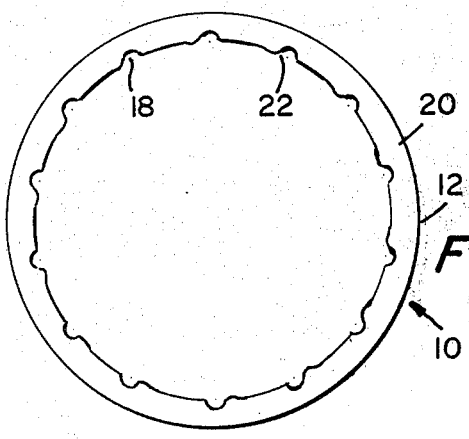
FIG. 2
FIG. 4
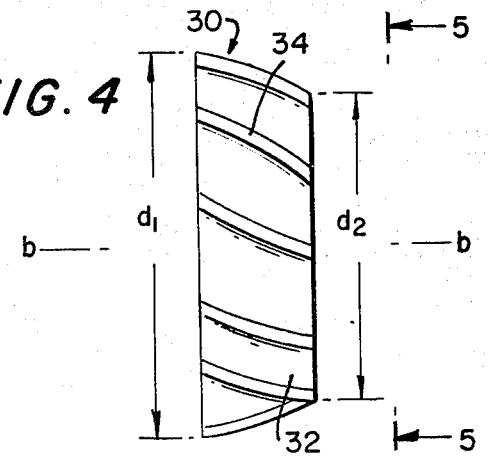
FIG. 5
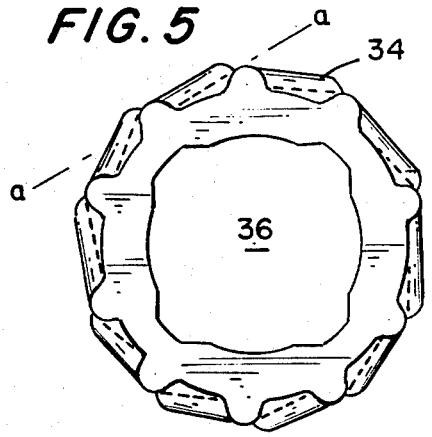

MEASURED PRESSURE DROP AT AMBIENT TEMPERATURE

INTERNALLY GROOVED HEAT TRANSFER CONDUIT

BACKGROUND OF THE INVENTION

This invention relates to an improved heat transfer conduit, and more particularly, to a heat transfer tube through which a vaporizable fluid is passed in heat exchange relation with a source of heat such as hot gases.

Most vapor generators include a plurality of heat transfer tubes through which a vaporizable fluid is passed. The tubes are usually subjected to a source of heat, such as hot gases in a furnace, and serve to transfer heat to the fluid passing therethrough. Water is one such vaporizable fluid used in these vapor generators. As the water is passed through the tubes, which are usually metallic, steam may form at the interface of the water and the internal surface of the tube. This formation of steam inhibits the transfer of heat from the tube to the water passing through the tube.

It has been known that internal grooving, or rifling, of tubes can improve the heat transfer between the fluid flowing through the tube and the tube itself. In some known grooving or rifling methods, grooves are cut into a tube wall, and tube wall material is removed as a consequence. In other known grooving methods, the tube is drawn over a groove forming plug such that the inside and outside tube diameters are reduced, with grooves being formed in the inside wall as the wall contacts the groove forming plug. In neither of these operations is tube internal wall material relocated so as to form a lip adjacent the grooves formed. The instant invention provides an improvement in an internally grooved tube that serves to promote mixing of fluid contained in heat transfer tubes so as to reduce or eliminate any vapor barrier that could be formed between the liquid and the tube surface and thereby improve heat transfer between the tube and the fluid.

SUMMARY OF THE INVENTION

In accordance with the invention there has been provided a heat transfer conduit for passing a vaporizable fluid in heat exchange relation with a source of heat. The conduit includes a generally cylindrical elongated body portion having an internal wall in which a groove is formed. The groove extends along the length of the body portion and defines a helix. A lip formed on the tube internal wall, is disposed adjacent the groove, extending with the groove along the length of the body portion so as to define a helix.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in connection with the accompanying drawings, wherein:

FIG. 1 is a perspective view of the heat exchange tube of the instant invention;

FIG. 2 is a plan view taken along lines 2—2 of FIG. 1 showing the cross section of the grooves, and lips adjacent thereto;

FIG. 3 is a plan view similar to FIG. 2 but showing an embodiment in which some grooves and lips are of different sizes than others;

FIG. 4 is an elevational view of a rifling tool that can be used for manufacturing the tube of the present invention;

FIG. 5 is a plan view of the tool of FIG. 4 taken along line 5—5 of FIG. 4.

DESCRIPTION OF THE PREFERRED EMBODIMENT

Figure 6:
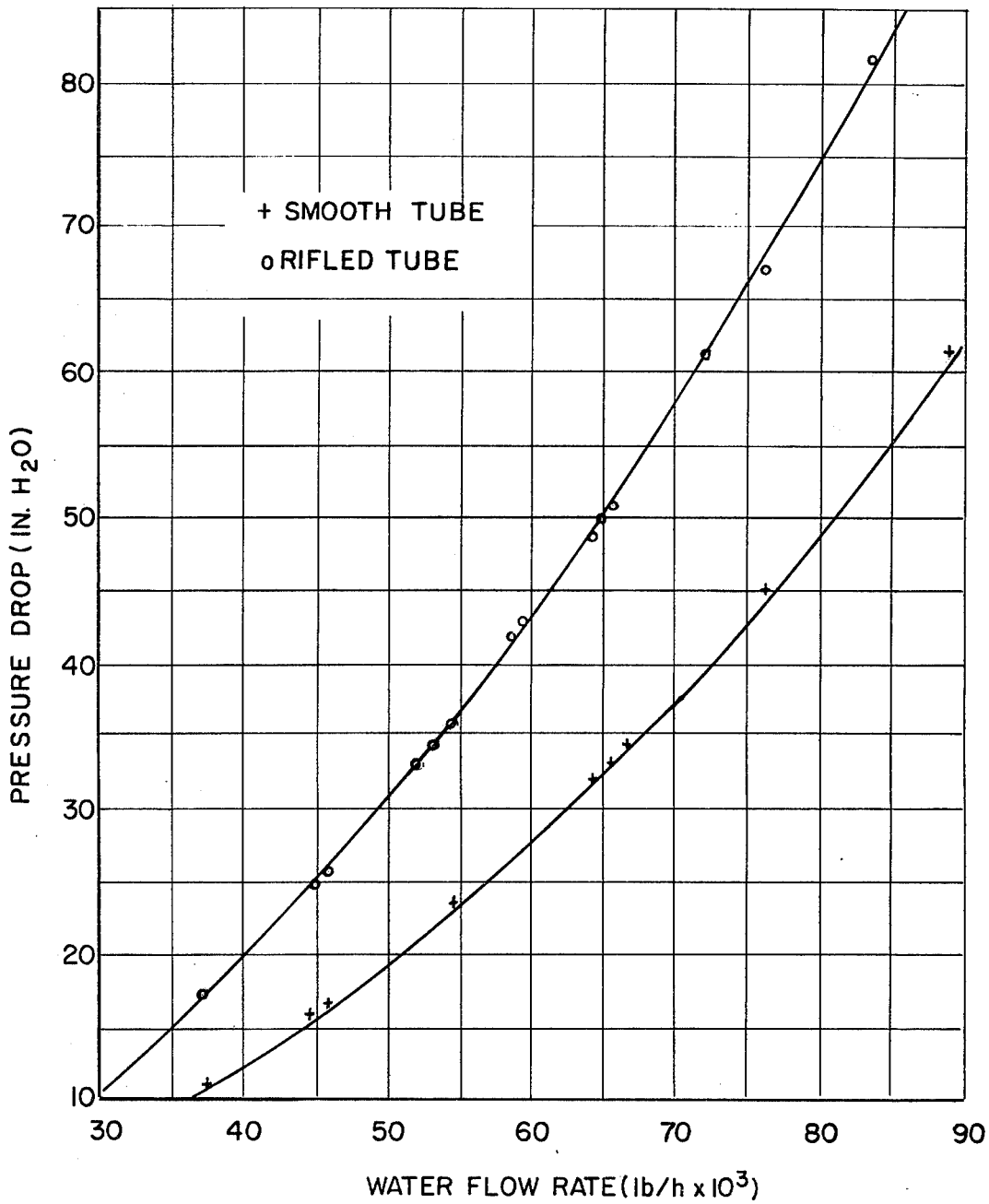
FIG. 6 is a graph comparing characteristics of a smooth bore tube against a tube of the present invention.

Referring to the drawings, in FIG. 1 a perspective view is shown of a tube 10 of the present invention. The tube 10 includes an elongated cylindrical body portion 12 with openings at opposite ends 14, 16. Preferably the tube 10 is made of a metal, such as iron or steel. The direction of flow of a vaporizable fluid is shown by arrows such that the opening at end 14 acts as a tube inlet, and the opening at end 16 acts as a tube outlet. Of course it should be understood that flow could be in an opposite direction from that shown, in which case openings at respective ends 14, 16 would act as outlet and inlet respectively.

Grooves 18 are formed in the internal wall 20 of tube 10. These grooves 18 extend along the length of the body portion 12, and define respective helices. Adjacent each groove 18, disposed along an edge of each respective groove 18, is a lip 22. Each lip 22 comprises tube wall material that has been relocated by being pushed out of the path of a rifling tool that is passed through the tube during a groove forming operation, which operation will be described hereinafter. It should be noted that when a groove 18 defines a clockwise helical path from the inlet to the outlet of a tube, such as is shown in FIG. 1, the lip 22 is formed adjacent the right edge of a groove 18 as a result of the tooling operation, whereas if a groove were to define a counterclockwise helical path, the lip would be formed along the left edge of the groove.

Turning to FIG. 2, the cross-section of grooves 18 and lips 22 are shown. Because of the shape of forming edges of the tool used for making these grooves, each groove 18 has a generally semi-circular cross-section. It is to be understood that grooves can take on different configurations dependent upon the shape of the forming edges of the tool employed. In the particular embodiment shown in FIG. 2 each lip 22 and associated groove 18 together define a generally S-shaped irregularity in the tube internal wall 20 when viewed in a plane normal to the longitudinal axis of tube 10.

It should be understood that a plurality of grooving operations can be performed on an individual tube in order to obtain a desired number of grooves and associated lips. For example, the fourteen groove arrangement of the tube of FIG. 1 could have been formed by passing a tool having fourteen groove forming protrusions once through a smooth bore tube, or by passing a tool having seven groove forming protrusions twice through a tube, with proper groove spacing being established during the second pass by locating the tool protrusions half way between grooves formed during the first pass. Furthermore, different tools could be used during different operations so that some grooves and related lips would have shapes and/or dimensions different from others. The tube shown in FIG. 3 includes a first series of grooves 23 which extend only slightly into the tube wall, and a second series of grooves 25 which extend further into the tube wall. Since grooves 23 are not as deep as grooves 25, lips 27 associated with grooves 23 are somewhat smaller than lips 29 associated with grooves 25.

Turning now to FIGS. 4 and 5, a tool 30 is shown that can be used to form the groove and lip configuration of the present invention in a tube internal wall. The tool 30 shown would be used to form ten symmetrically spaced grooves and related lips in the internal wall of a tube, whereas a fourteen groove forming tool could have been used in making the tube of FIGS. 1 and 2. Tool 30 includes a generally frusto-conical portion 32, having a major outside diameter $d_1$ and a minor outside diameter $d_2$. A plurality of generally semi-cylindrical protrusions 34 are disposed about the outside surface of portion 32. As shown in FIG. 4, each protrusion 34 has a major axis a—a extending at an angle to the longitudinal axis b—b of tool 30, and generally parallel to the external surface of portion 32. Tool 30 can be pulled or pushed through a smooth bore tube such that the smaller diameter end of tool 30 precedes the larger diameter end of tool 30, through the tube. Adjacent the narrow end the overall outside dimension of tool 30 between opposite protrusions 34 is approximately equal to the inside diameter of tube 10. As tool 30 is passed through a tube, the protrusions 34 at their ends adjacent the narrow end of tool 30 engage the tube internal wall 20 and gradually force tube wall material out of their respective paths, with the result that grooves 20 are formed and material being relocated forms lips 22. As tool 30 passes through tube 10 the grooves are deepened since the protrusions 34 extend gradually further away from the central longitudinal axis b—b of the tool 30. In order to obtain a groove that defines a helix, tool 30 is rotated about its longitudinal axis b—b as it is pushed or pulled through tube 10. Tube 30 is rotated in a clockwise direction in order to form clockwise helical grooves of the type shown in FIG. 1. A hole 36 is formed through portion 32 to allow for securing tool 30 to a mandrel that can be pushed or pulled through a tube.

If desired, some of the grooving operations may form grooves and lips defining helices which cross other helices, for example with some helices extending clockwise, and others extending counterclockwise, or with some grooves having a different pitch than other grooves.

In the operation of a tube of the present invention a vaporizable fluid flows through tube 10 which is subjected to a source of heat such as hot gases. The tube 10 absorbs heat from the source, and transfers it to the fluid. The grooves 18 promote additional turbulence. As a result the liquid phase of the fluid passing through tube 10 tends to wet the internal wall 20, thereby enhancing heat transfer between the tube 20 and fluid passing therethrough.

One method used to compare heat transfer capability of fluid flow conduits, such as heat exchanger tubes, is to measure and compare pressure drop (resistance to flow) along a tube length. The results of laboratory tests comparing measured pressure drop through a smooth bore tube, and a tube of the instant invention are set forth in FIG. 6. Curve A represents a smooth bore tube, and tube B represents a tube of the present invention.

It is evident from these test results that the tube of the present invention is characterized by a higher pressure drop, and therefore would have a better heat transfer capability than a smooth bore tube.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generating tube for passing a vaporizable fluid in heat exchange relation with a source of heat, said fluid absorbing heat as it passes through said tube, comprising:

(a) a generally cylindrical body including an internal wall said fluid being exposed to said wall, (b) a first portion of said internal wall forming a generally cylindrical passageway, (c) a second portion of said internal wall forming a groove extending along the length of said body and defining a helix, and (d) a third portion of said internal wall forming a lip disposed adjacent said groove, and extending with said groove along the length of said body, said lip defining a helix.

2. The vapor generating tube of claim 1 wherein said generally cylindrical body comprises a metal tube having a longitudinal axis an inlet at one end and an outlet at another end thereof, said helix defined by said groove extending along the length of said metal tube in a clockwise manner along the longitudinal axis of said tube, said lip being disposed adjacent the right edge of said groove.

3. The vapor generating tube of claim 1 wherein said generally cylindrical body comprises a metal tube having a longitudinal axis, an inlet at one end and an outlet at another end thereof, said helix defined by said groove extending along the length of said tube in a counterclockwise manner about the longitudinal axis of said tube, said lip being disposed adjacent the left edge of said groove.

4. The vapor generating tube of claim 1 wherein said second portion of said internal wall forms a plurality of grooves, said grooves being spaced apart from one another, a part of said first portion of said wall disposed between said grooves, each of said lips being disposed adjacent a respective groove and extending along the length of said body.

5. The vapor generating tube of claim 4 wherein some of said grooves extend deeper into said wall than others of said grooves.

6. The vapor generating tube of claim 5 wherein said generally cylindrical body comprises a metal tube having a longitudinal axis, and wherein some of said lips extend further toward said longitudinal axis than others of said lips, respective ones of said further extending lips being adjacent respective ones of said deeper grooves.

7. The vapor generating tube of claim 4 wherein said generally cylindrical body comprises a metal tube having a longitudinal axis and wherein some of said lips extend further toward said longitudinal axis than others of said lips.

8. The vapor generating tube of claim 4 wherein said body comprises a metal tube having a circular cross section, said grooves and adjacent lips together defining generally S-shaped irregularities in the cross-section of said internal wall, said S-shaped irregularities being spaced apart from one another, parts of said first portion of said internal wall disposed between said S-shaped irregularities.

9. The heat transfer conduit of claim 4 wherein one of said grooves has a pitch different from the pitch of another of said grooves, said grooves of different pitch crossing one another along the length of said body portion.

* * * * *